US005691672A

United States Patent [19]

Cruchon et al.

[11] Patent Number: 5,691,672

[45] Date of Patent: Nov. 25, 1997

[54] MAGNETIC COUPLING DEVICE BETWEEN A TEM LINE MAIN CONDUCTOR AND A WAVEGUIDE FORMING A λG/2 RESONATOR

[75] Inventors: Jean-Claude Cruchon, Bouffemont; Jean Denis Schubert, Verneuil sur Seine, both of France

[73] Assignee: Alcatel Telspace, Nanterre Cedex, France

[21] Appl. No.: 691,387

[22] Filed: Aug. 2, 1996

[30] Foreign Application Priority Data

Aug. 4, 1995 [FR] France ..... 95 09540

[51] Int. Cl.[6] ..... H01P 5/103

[52] U.S. Cl. ..... 333/26; 333/212; 333/230

[58] Field of Search ..... 333/26, 208, 209, 333/212, 230, 232

[56] References Cited

U.S. PATENT DOCUMENTS 3,758,886 9/1973 Landry et al. ..... 333/26

4,626,809 12/1986 Mizumura et al. ..... 333/209 X

*Primary Examiner*—Paul Gensler

*Attorney, Agent, or Firm*—Sughrue, Mion, Zinn, Macpeak & Seas, PLLC

[57] ABSTRACT

A magnetic device couples a main conductor of a TEM line and a waveguide forming a λg/2 resonator and procuring the propagation of an electromagnetic wave. The main conductor is fixed to a wall of the waveguide and extended by a pin inside the waveguide. The device comprises a tuning screw penetrating into the waveguide near the free end of the pin and perpendicular to the pin and an iris around and centered on the pin. The iris is closed on the side on the wall and its interior volume forms a zone in which the wave of the associated magnetic field is evanescent. The median axis of the tuning screw is in the plane of the aperture of the iris.

6 Claims, 2 Drawing Sheets

MAGNETIC COUPLING DEVICE BETWEEN A TEM LINE MAIN CONDUCTOR AND A WAVEGUIDE FORMING A λG/2 RESONATOR

BACKGROUND OF THE INVENTION

1. Field of the Invention

The field of the invention is that of coupling together devices for transmitting dissimilar signals and is more particularly concerned with a magnetic coupling device between a TEM line main conductor and a waveguide forming a λg/2 resonator, λg being the wavelength of the guided wave.

2. Description of the Prior Art

A microwave resonator comprises a waveguide in which one of the signal propagation axes is delimited to form a resonator equivalent to a multiple of λg/2. A waveguide technology bandpass filter can be implemented using a number of such resonators, as shown in FIGS. 1 and 2.

FIGS. 1 and 2 are respectively top and cross-section views of a prior art waveguide technology bandpass filter comprising three λg/2 resonators.

Referring to FIG. 1, a waveguide 10 includes a first port in the form of a flange 11 for fixing it to another waveguide. This waveguide 10 constitutes a bandpass filter comprising three direct-coupled λg/2 resonators 12 through 14 each of which comprises two rod irises 15–16, 17–18 and 19–20. The resonators 12 through 14 are all synchronous with the center frequency of the bandpass filter and the global transfer function of the filter is obtained by modifying the coupling between the various resonators. The coupling between resonators and the port coupling is varied by means of screws 41, 42, 43 and 26 forming plungers. The screws (plungers) 21, 22, 23 adjust the synchronism of the various resonators. The second port is an SMA type plug 24. The plug 24 is adapted to be connected to a coaxial cable (TEM line) the core of which is extended into the cavity by a pin 25 forming an antenna. The pin 25 is insulated from the waveguide 10 by a PTFE cylinder 36. The coupling between the core of the coaxial cable and the λg/2 resonator is completed by a tuning screw 26 entering the cavity (guide) near the free end 27 of the pin 25, the tuning screw 26 being perpendicular to the pin 25. The coupling is magnetic, i.e. the tuning screw 26 is located on lines of the magnetic field of the signal conveyed into the cavity. The pin 25 and the tuning screw form a susceptance at $1/L\omega$.

The drawback of a coupling device comprising only one pin and one tuning screw is that the adjustment of the synchronism of the resonator 14 by the plunger 23 interacts with the adjustment of the output coupling by the screw 26. The various couplings are then difficult to adjust and it may be difficult to arrive at an optimum adjustment. In particular, the couplings between resonators are not optimized and as a result equal ripple in the passband of the filter is difficult to achieve.

Moreover, it is not possible in this case to obtain tuning over a wide frequency range. Thus the operating bandwidth is reduced.

An object of the present invention is to overcome these drawbacks.

To be more precise, one object of the invention is to provide a magnetic coupling device between a main conductor of a TEM line and a waveguide forming a λg/2 resonator in which the adjustment of the synchronism of the resonator 14 and the adjustment of the TEM line access susceptance are decorrelated.

SUMMARY OF THE INVENTION

The invention comprises a magnetic coupling device between a main conductor of a TEM line and a waveguide forming a λg/2 resonator and procuring the propagation of an electromagnetic wave, said main conductor being fixed to a wall of said waveguide and extended by a pin inside said waveguide, said device comprising a tuning screw penetrating into said waveguide near the free end of said pin and perpendicular to said pin and an iris around and centered on said pin, said iris being closed on one side by said wall and its interior volume forming a zone in which the wave of the associated magnetic field is evanescent, the median axis of said tuning screw being in the plane of the aperture of said iris.

The iris then constitutes a closed evanescent guide and the adjustment of the tuning screw has little influence on the synchronism of the input or output resonator.

The distance between the end of the pin on the wall and the end of the tuning screw opposite its fixed end is advantageously less than λ/4 where λ is the wavelength of the electromagnetic wave.

The waveguide used can be rectangular or cylindrical in shape.

The invention applies with advantage to the case in which the magnetic coupling is provided by a pin connected to the core of a coaxial cable.

The length of the pin is preferably equal to the depth of the iris.

Other features and advantages of the invention will emerge from a reading of the following description of a preferred embodiment given by way of non-limiting illustrative example only and from the appended drawings.

DETAILED DESCRIPTION OF THE PREFERRED EMBODIMENT

Figure 1:
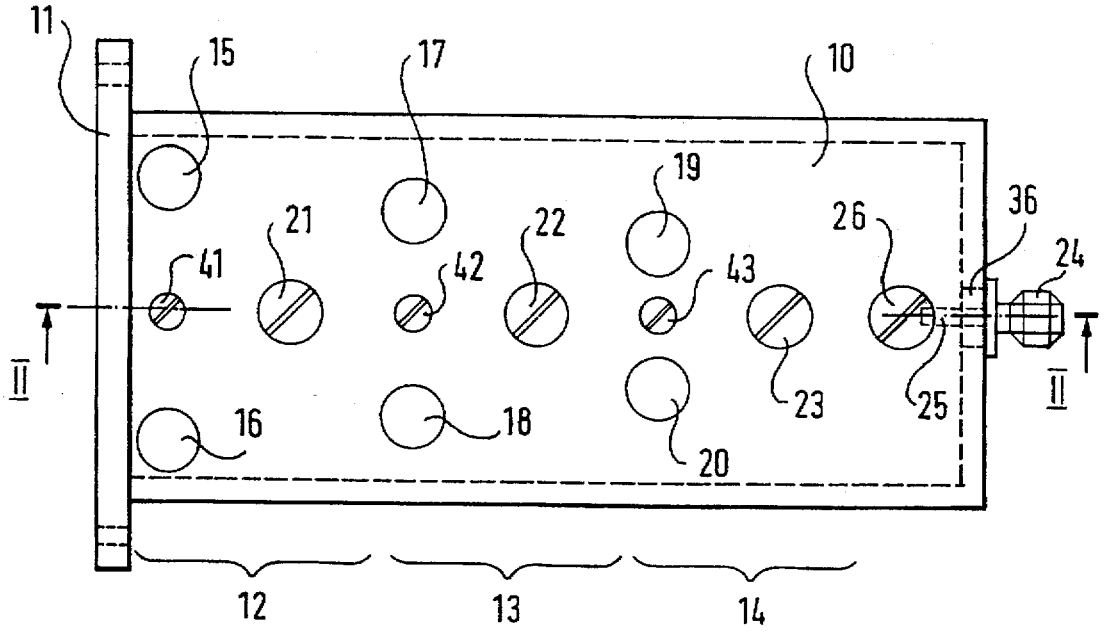
FIG. 1 PRIOR ART
FIGS. 1 and 2 are respectively top and cross-section views of a prior art waveguide technology bandpass filter including three λg/2 resonators.
Figure 2:
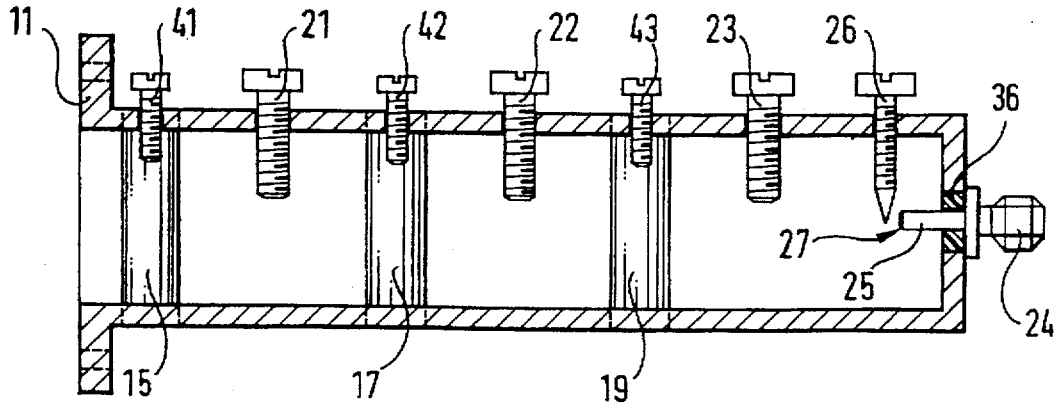
FIG. 2 PRIOR ART

FIGS. 1 and 2 have already been described with reference to the prior art.

Figure 3:
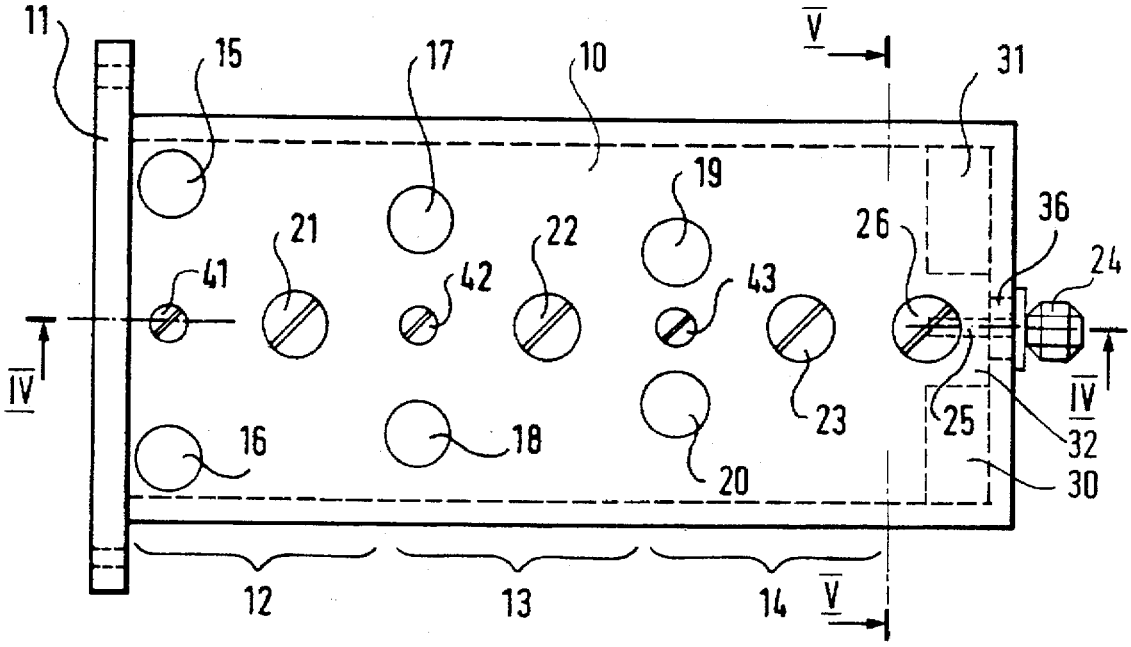
FIGS. 3 and 4 are respectively top and cross-section views of a waveguide technology bandpass filter of the invention also including three λg/2 resonators.
Figure 4:
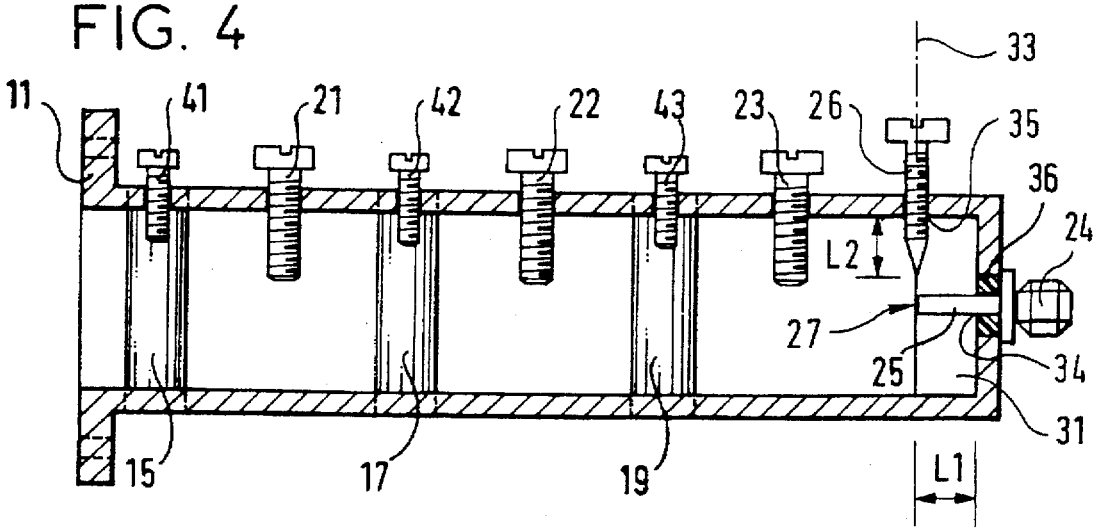

FIGS. 3 and 4 are respectively top and cross-section views of a waveguide technology bandpass filter of the invention including three λg/2 resonators. Items identical to their counterparts in FIGS. 1 and 2 carry the same reference numbers.

In accordance with the invention, the coupling device to the main conductor of the TEM line, for example the core of a coaxial cable constituting the TEM line, includes an iris around and centered on the pin 25. The iris 30, 31 (FIG. 3) is constituted by two parallelepiped-shape metal blocks. The iris 30, 31 is closed on one side by the wall to which the SMA plug 24 is fixed and its interior volume 32 forms a zone in which the wave associated with the magnetic field is evanescent, as explained later with reference to FIG. 5. The median axis 33 (FIG. 4) of the tuning screw 26 is in the plane of the aperture of the iris 30, 31.

As in the cited prior art, the resonators 12 through 14 are synchronous with the center frequency of the bandpass filter and the couplings between resonators operate on the transfer function in accordance with the required passband. The coupling between the resonators widens the passband of the filter.

Each resonator has a Q defined by its medium (air in this instance), by the volume of the space between the rods 15 through 20, by the surface material used, by surface imperfections (asperities, craters, etc), by the polish of the surfaces, etc.

Figure 5:
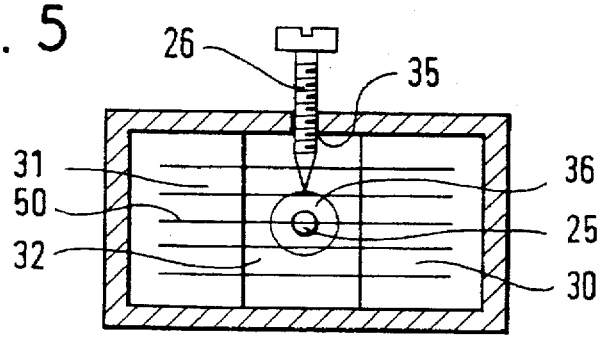
FIG. 5 is a view in section on the line V—V in FIG. 3 and showing the lines of the magnetic field.

The coupling is magnetic at the pin 25 and the screw 26. As shown in FIG. 5, which is a sectional view on the line V—V in FIG. 3, part of the magnetic field, schematically represented by the field lines 50, enters the volume 32 of the iris and this part is sampled by the pin 25 and the screw 26. Within this volume coupling is to the magnetic field of an associated evanescent wave. The magnetic field near and in the iris is perpendicular to the coupling device.

The iris 30, 31 is a conventional coupling iris which in this application has the particular feature of being closed on one side. Its open entry cross-section is in the plane of the median axis 33 of the screw 26 and preferably coincides with the free end 27 of the pin (FIG. 4). This is equivalent to saying that the length of the pin 25 is equal to the depth of the iris 30, 31.

The SMA connector used is of the standard type and has an outside diameter of 4.15 mm, a core 1.27 mm in diameter and a PTFE dielectric.

The sum of the distance L1 between the end 34 of the pin on the end wall (FIG. 4) and the free end of the gun 25 and the distance L2 between the end 35 of the tuning screw 26 and its free end (FIG. 4) is less than $\lambda/4$ where $\lambda$ is the wavelength of the electromagnetic wave. Thus $L1+L2<\lambda/4$. The distance between the free end of the tuning screw 26 and the end 27 of the pin is small and a capacitance is obtained between these two components. This distance, added to L1+L2 is equal to $\lambda/4$.

The main advantage of the invention is that there is a large gap between the cavity and the output coupling. The iris represents a relatively small load on the waveguide cavity and the adjustments are decorrelated. To be more precise, the frequency translation function of the filter and the TEM line coupling function are decorrelated. Thus equal ripple is intrinsically maintained throughout the band and losses are reduced. What is more, the bandwidth of the filter is increased relative to the prior art.

The invention applies not only to rectangular resonators but also to cylindrical resonators. The theory is the same, provided that the field is perpendicular to the susceptance formed by the coupling screws.

Likewise, the iris is not necessarily rectangular as shown in FIGS. 3 and 5, but may be oblong or circular. In the latter case the iris is in the form of a hollow cylinder.

In FIGS. 3 through 5 the port in accordance with the invention is at the end of the guide but this port can equally well be formed on a lateral wall of the guide, the essential being that an evanescent wave is present inside the iris.

The coupling device described thus far has been used to construct a five-pole (five resonators) bandpass filter tuned from 7 600 MHz to 8 400 MHz, the passband of the filter being 30 MHz and the equal ripple reduced to 0.01 dB across this band, corresponding to a standing wave ratio (SWR) at the input of 1.1.

As previously mentioned, the end of the pin 25 is ideally level with the entry cross-section of the iris. It is nevertheless possible to lengthen the pin so that it projects into the guide, beyond the entry cross-section of the iris. In this case it electrically "shrinks" the cavity and increases the frequency (the effect is the equivalent of using a smaller cavity). In this way it is possible to make good mechanical asymmetries, such as those previously mentioned.

The coupling of the invention, like that of the prior art, is a reciprocal or passive form of coupling, and can therefore be a signal input or a signal output coupling.

The TEM line is not necessarily a coaxial cable and can be a microstrip line, for example.

The invention applies with advantage to narrow-band filters, having a passband in the order of a few tens of MHz.

There is claimed:

1. Magnetic coupling device between a main conductor of a TEM line and a waveguide forming a $\lambda g/2$ resonator and procuring the propagation of an electromagnetic wave, said main conductor being fixed to a wall of said waveguide and extended by a pin inside said waveguide, said device comprising a tuning screw penetrating into said waveguide near the free end of said pin and perpendicular to said pin and an iris around and centered on said pin, said iris being closed on one side by said wall and its interior volume forming a zone in which the wave of the associated magnetic field is evanescent, the median axis of said tuning screw being in the plane of the aperture of said iris.

2. Device according to claim 1 wherein the distance measured along said pin and tuning screw between the end of said pin on said wall and the end of said tuning screw opposite its free end is no more than $\lambda/4$ where $\lambda$ is the wavelength of said electromagnetic wave.

3. Device according to claim 1 wherein said waveguide is rectangular in shape.

4. Device according to claim 1 wherein said waveguide is cylindrical in shape.

5. Device according to claim 1 wherein said main conductor is the core of a coaxial cable constituting said TEM line.

6. Device according to claim 1 wherein the length of said pin is equal to the depth of said iris.

* * * * *